United States Patent [19]

Land et al.

[11] 4,352,874

[45] Oct. 5, 1982

[54] METHOD FOR FORMING A PHOTOSENSITIVE SILVER HALIDE ELEMENT

[75] Inventors: Edwin H. Land, Cambridge; Vivian K. Walworth, Concord, both of Mass.

[73] Assignee: Polaroid Corporation, Cambridge, Mass.

[21] Appl. No.: 298,638

[22] Filed: Sep. 2, 1981

[51] Int. Cl.[3] ..... G03C 1/76; G03C 1/02

[52] U.S. Cl. ..... 430/568; 430/564; 430/567; 430/569; 430/935; 430/496; 430/948

[58] Field of Search ..... 430/568, 569, 567, 641, 430/643, 11, 13, 932, 935, 496, 948

[56] References Cited

U.S. PATENT DOCUMENTS

| | | | |
|---|---|---|---|
| 3,320,069 | 5/1967 | Illingsworth et al. | 430/603 |
| 4,046,576 | 9/1977 | Terwilliger et al. | 430/569 |
| 4,150,994 | 4/1979 | Maternaghan | 430/567 |

OTHER PUBLICATIONS

Duffin, *Photographic Emulsion Chemistry*, 1966 p. 59.

Whitmore, WO 80/01614, Published Aug. 7, 1980.

*Primary Examiner*—Mary F. Downey

*Attorney, Agent, or Firm*—Philip G. Kiely

[57] ABSTRACT

A fine-grain emulsion in a plurality of predetermined spaced depressions is coalesced to form, in situ, a plurality of single effective silver halide grains in a predetermined spaced array by the action of a solution of a silver halide solvent containing a dissolved silver salt.

35 Claims, 2 Drawing Figures

1μm

METHOD FOR FORMING A PHOTOSENSITIVE SILVER HALIDE ELEMENT

BACKGROUND OF THE INVENTION

In the formation of photosensitive silver halide emulsions, the ripening or growing step during which time the silver halide grains grow is considered important. During the ripening stage an adequate concentration of a silver halide solvent, for example, excess halide, generally bromide, is employed which renders the silver halide much more soluble than it is in pure water because of the formation of complex ions. This facilitates the growth of the silver halide grains. While excess bromide and ammonia are the most common ripening agents, the literature also mentions the use of water-soluble thiocyanate compounds in place of bromide as well as a variety of amines. See, for example, *Photographic Emulsion Chemistry,* G. F. Duffin, The Focal Press, London, 1966, page 59.

The art has also disclosed the employment of a water-soluble thiocyanate compound during the formation of the grains, that is, during the actual precipitation of the photosensitive silver halide. For example, U.S. Pat. No. 3,320,069 discloses a water-soluble thiocyanate compound which is present as a silver halide grain ripener either during precipitation of the light sensitive silver halide or added immediately after precipitation. The precipitation of the silver halide grains in the aforementioned patent is carried out, however, with an excess of halide.

U.S. Pat. No. 4,046,576 is directed to a method for the continuous formation of photosensitive silver halide emulsions wherein a silver salt is reacted with a halide salt in the presence of gelatin to form a photosensitive silver halide emulsion and said formation takes place in the presence of a sulfur-containing silver halide grain ripening agent, such as a water-soluble thiocyanate compound, and the thus-formed silver halide emulsion is continuously withdrawn from the reaction chamber while silver halide grain formation is occurring. During precipitation the halide concentration in the reaction medium is maintained at less than 0.010 molar. The patent states that it is known in the art to prepare silver halide grains in the presence of an excess of silver ions. The patent relates to such a precipitation with the additional steps of continually adding the sulfur-containing ripening agent and continually withdrawing silver halide grains as they are formed.

U.S. Pat. No. 4,150,944 is directed to a method of forming silver iodobromide or iodochloride emulsions which are of the twinned type which comprises the following steps:

(a) forming a monosized silver iodide dispersion;
(b) mixing in the silver iodide dispersion aqueous solutions of silver nitrate and alkali or ammonium bromides or chlorides in order to form twinned crystals;
(c) performing Ostwald ripening in the presence of a silver solvent, such as ammonium thiocyanate, to increase the size of the twinned crystals and dissolve any untwinned crystals;
(d) causing the twinned crystals to increase in size by adding further aqueous silver salt solution and alkali metal or ammonium halide; and
(e) optionally removing the water-soluble salts formed and chemically sensitizing the emulsion.

Copending application of Arthur M. Gerber, Ser. No. 194,561, filed Oct. 6, 1980 (common assignee) is directed to a method for forming narrow grain size distribution silver halide emulsions by the following steps:

1. Forming photosensitive silver halide grains in the presence of a water-soluble thiocyanate compound with a halide/silver molar ratio ranging from not more than about 5% molar excess of halide to not more than about a 25% molar excess of silver; and 2. Growing said grains in the presence of said water-soluble thiocyanate compound for a time sufficient to grow said grains to a predetermined grain size distribution.

Copending application of Edwin H. Land, Ser. No. 234,937, filed Feb. 17, 1981 (common assignee), is directed to a method for forming a predetermined spaced array of sites and then forming single effective silver halide grains at said sites. Thus, by forming the sites in a predetermined spatial relationship, if the silver halide grains are formed only at the sites, each of the grains will also be located at a predetermined and substantially uniform distance from the next adjacent grain and their geometric layout will conform to the original configuration of the sites.

The term, "single effective silver halide grain," refers to an entity at each site which functions photographically as a single unit which may or may not be crystallographically a single crystal but one in which the entire unit can participate in electronic and ionic processes such as latent image formation and development.

Copending application Ser. No. 234,937 discloses one method for forming sites by exposing a photosensitive material to radiation actinic to said photosensitive material and developing the so-exposed photosensitive material to provide sites for the generation of silver halide corresponding to the pattern of exposure and then forming photosensitive silver halide grains at the sites. In a preferred embodiment, the sites are provided by the predetermined patterned exposure of the photoresist whereby upon development of the exposed photoresist a relief pattern is obtained wherein the peaks or valleys comprise the above-described sites.

While the single effective silver halide grains may be formed employing the described photoresist relief pattern, it is preferred to replicate the relief pattern by conventional means, for example, by using conventional electroforming techniques to form an embossing master from the original relief image and using the embossing master to replicate the developed photoresist pattern in an embossable polymeric material.

Copending application of Arthur M. Gerber, Ser. No. 298,640 filed concurrently herewith (common assignee) is directed to a method for forming a photosensitive element comprising a plurality of single effective silver halide grains, which method comprises coalescing a fine-grain emulsion in a plurality of predetermined spaced depressions in a surface. Preferably, the coalescence is effected by contacting the fine-grain emulsion with a silver halide solvent.

SUMMARY OF THE INVENTION

A photosensitive element comprising a plurality of single effective silver halide grains in a predetermined spaced array is formed by coalescing, in situ, a fine-grain emulsion in a plurality of predetermined spaced depressions in a surface by contacting said emulsion with a solution of a silver halide solvent containing a dissolved silver salt.

DETAILED DESCRIPTION OF THE INVENTION

Figure 1:
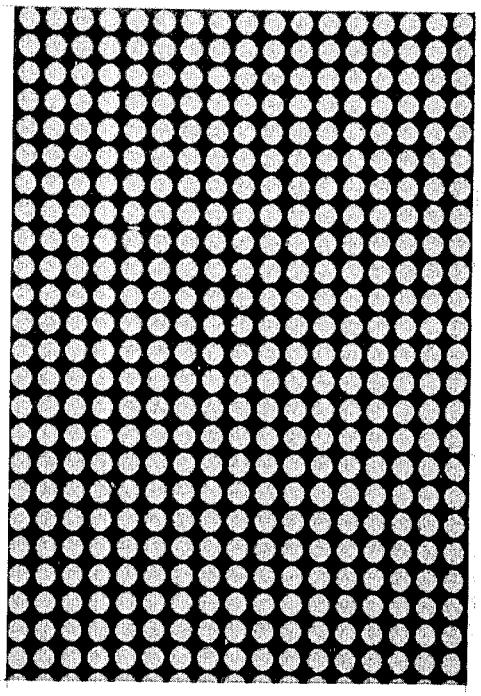
FIG. 1 is an electron micrograph of an element prepared by the method of the present invention.

The present invention is directed to a method for coalescing a fine-grain emulsion in predetermined spaced depressions into a single effective silver halide grain in each depression wherein said coalescence is carried out by contacting said fine-grain emulsion with a solution of a silver halide solvent containing a dissolved silver salt.

The present invention employs predetermined spaced depressions, e.g., a relief pattern formed by procedures set forth in copending applications Ser. Nos. 234,937 and 234,939.

The silver halide grains will be formed in each of these depressions and, since the depressions we formed in a predetermined pattern, the resulting silver halide grains will also be arrayed in the same pattern.

A fine-grain silver halide emulsion is applied to the relief pattern in a manner that results in substantially all of the applied emulsion being contained in the aforementioned depressions with little being located on the planar or plateau-like surface of the photoresist between the depressions. As will be seen below, if some grains are retained on the planar surface, it is not detrimental to the formation of the element, since subsequent operations will deposit most of the grains into the depressions.

The term "fine-grain emulsion" as used herein is intended to refer to a silver halide emulsion containing grains of a size which would permit a number of grains to be deposited within each depression and which also would be sufficiently small to substantially conform to the contours of the depressions. Preferably, a silver halide emulsion containing grains between about 0.01 and 0.50 μm in diameter is employed. Particularly preferred is a silver halide emulsion having a grain size with an average diameter of about 0.1 μm or less.

Since the silver halide grains must be kept in suspension prior to depositing them in the depressions, there is a polymeric binder material, generally gelatin, also present. It is preferred that the binder-to-silver ratio be relatively low since an excessive amount of binder such as gelatin may slow or inhibit the subsequent single grain formation. In addition, excessive binder would occupy space in the depressions that could be taken by silver halide grains or silver halide solvent. Preferably, the gel-to-silver ratio is 0.1 or less and more preferably about 0.075. It is also preferred that the fine-grain emulsion be dried in the depressions prior to the next processing step so that subsequent processing steps will not result in the displacement or loss of the fine grain silver halide emulsion from the depressions.

It is also preferred that surfactants be employed to facilitate coating of the emulsion in the depressions. In a preferred embodiment, the surfactants comprise a combination of AEROSOL OT (dioctyl ester of sodium sulfosuccinic acid) American Cyanamid Co., Wayne, N.J., and MIRANOL J2M-SF (dicarboxylic caprylic derivative sodium salt) Miranol Chemical Co., Inc., Irvington, N.J., in a 1 to 3 ratio by weight, respectively, at about a 0.1% concentration by weight, based on the weight of the emulsion.

The term "coalescence" is used herein in the broad sense and is intended to refer to the total process involving the formation of the single effective silver halide grains and it is intended to include both Ostwald ripening and coalescence ripening.

Subsequent to the deposition of the fine-grain emulsion in the depressions, coalescence of the grains into a single effective silver halide grain is accomplished by the application of a solution of silver halide solvent containing a silver salt so that in each depression there occurs a partial dissolution of the emulsion. Sufficient solvent must be employed to achieve suitable single effective grain formation as determined by photographic speed, $D_{min}$, $D_{max}$ and the like, but an excessive amount should be avoided so that the fine-grain emulsion will not be removed from the depressions.

Any suitable silver halide solvent known to the art and combinations thereof may be employed in the practice of the present invention. As examples of such solvents mention may be made of the following: soluble halide salts, e.g., lithium bromide, potassium bromide, lithium chloride, potassium chloride, sodium bromide, sodium chloride; sodium thiosulfate, sodium sulfate, ammonium thiocyanate, potassium thiocyanate, sodium thiocyanate; thioethers such as thiodiethanol; ammonium hydroxide, organic silver complexing agents, such as ethylene diamine and higher amines.

Any suitable silver salt which is not photographically detrimental may be employed. Preferably silver halide such as silver chloride or silver bromide, or silver thiocyanate is employed. The concentration of silver in the silver halide solvent solution is not critical and may vary over a wide range. An amount effective to obtain the result desired, is employed. As little as about 0.2% of a concentration of silver, by weight, based on the weight of the solutions can be used or as much as a saturated solution. More preferably, a 0.5% concentration of silver is employed. In order to avoid any variability in the effects of the silver salt, it is preferred to employ in the silver halide solvent solution a concentration of dissolved silver salt which is below saturation.

For ease of application a small amount of polymeric binder material, preferably gelatin, may be employed in the solution of silver halide solvent. Suitable amounts of binder range from about 0 to 10%.

The small amount of fine-grain silver halide emulsion referred to which is initially deposited on the planar surfaces is generally deposited into the depressions by the application of the silver halide solvent solution. Even after coalescence some grains may remain on the planar surface but compared to the single effective grain formed in each depression they are photographically insignificant.

As described in application Ser. No. 298,640, subsequent to the addition of the solution of silver halide solvent, the plurality of fine silver halide grains in the depressions is coalesced into a single effective grain in each depression. Preferably, such coalescence includes the application of heat to accelerate the coalescence.

To insure that coalescence of the grains occurs only in the depressions, and to control the amount of silver halide solvent in each depression, a cover sheet which conforms to the planar or plateau-like surface of the relief pattern is preferably employed. After heating the partially dissolved grains, an optional cooling step is also preferred prior to removing the cover sheet in order to further assist the coalescence of the fine-grain emulsion into single effective grains in each depression.

After removal of the cover sheet, a relief pattern containing a predetermined spaced array of depressions each carrying a single effective silver halide grain is obtained.

Preferably, the solution of silver halide solvent is applied to a nip formed by the cover sheet and the emulsion-carrying depressions and the thus-formed laminate is passed through pressure-applying rollers.

Copending application of Arthur M. Gerber, Warren D. Slafer and Vivian K. Walworth, Ser. No. 298,639 filed concurrently herewith (common assignee) discloses and claims a process which employs a cover sheet comprising a hydrophilic layer in contact with the relief pattern during coalescence whereby single effective grains are retained on the hydrophilic layer subsequent to separation from the relief pattern.

A comparison of silver coverages of the initially deposited fine-grain emulsion and the final single effective silver halide grains show that substantially all the silver initially deposited remains after carrying out the procedure of the present invention.

The following examples illustrate the novel process of the present invention.

EXAMPLE 1

A fine-grain photosensitive silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, depth about 1 μm with center-to-center spacing of about 2.2 μm. The emulsion contained a 1 to 3 ratio, by weight, of AEROSOL OT and MIRANOL J2M-SF, respectively, at about a 0.1% concentration by weight based on the weight of the emulsion to facilitate coating. The emulsion-coated embossed base was then dried.

A silver halide solvent solution was prepared by adding 1 g of silver thiocyanate to 200 ml of a 9% ammonium thiocyanate solution in water, and heating the resulting mixture to 50° C. for about 15 min. The mixture was then cooled to 25° C. and the excess silver thiocyanate was removed by filtering with a 0.2 μm filter. The filtrate was diluted 1:1 by volume with a 2% gelatin solution.

The emulsion-coated embossed base was overlaid with a layer of 25 mg/ft$^2$ of gelatin carried on a subcoated cellulose triacetate support and passed through rubber rollers with pressure applied thereto while the silver halide solvent solution was applied to the nip formed by the emulsion-coated embossed base and the gelatin-coated cover sheet. The thus-formed lamination was heated for 2 min. at 67° C. and then cooled for about 2 min. at about −20° C. The gelatin-coated cover sheet was then detached from the embossed base. A regular spaced array of silver halide grains about 1.8 μm in diameter was partially embedded in the gelatin layer. FIG. 1 is an electron micrograph at 2000X magnification showing the gelatin layer and the grains.

EXAMPLE 2

A fine-grain photosensitive silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth and with center-to-center spacing of about 2.2 μm. The emulsion contained surfactants as described in Example 1 to facilitate coating. The emulsion-coated embossed base was then dried.

A series of experiments was carried out treating the thus-formed base with the below-indicated silver halide solvent solutions.

The emulsion-coated embossed base was overlaid with a layer of 25 mg/ft$^2$ of gelatin carried on a subcoated cellulose triacetate support and passed through rubber rollers with pressure applied thereto while the specified silver halide solvent solution was applied to the nip formed by the emulsion-coated embossed base and the gelatin-coated cover sheet. The thus-formed lamination was immersed in 85° C. water for 1 min., cooled for about 2 min. at about −20° C. and then the gelatin-coated cover sheet was detached from the embossed base. A regular spaced array of silver halide grains about 1.8 μm in diameter was partially embedded in the gelatin layer.

The transferred grains were spectrally sensitized by immersion in a solution of a panchromatic sensitizing dye (1 mg/ml) and 1% gelatin for 1 min. at room temperature (pAg=8.45; pH=6.31). The grains were dried, exposed to a step tablet and continuous wedge at 2 mcs and diffusion transfer processed with a Type 42 processing composition and Type 107C receiving sheet (Polaroid Corporation, Cambridge, Mass.) with an imbibition period of about 1 min.

The image densities were obtained from the negative and sensitometric curves plotted to obtain relative speeds. The first set of silver halide solvent solutions comprised a range of ammonium thiocyanate concentrations and 1% gelatin as controls. The remaining sets comprised the same series of concentrations of ammonium thiocyanate wherein the solutions contain dissolved silver thiocyanate, silver bromide and silver chloride, respectively. The example representing the optimum concentration of ammonium thiocyanate in each silver salt solution series was compared to the corresponding ammonium thiocyanate concentration control with the relative speed of each control example assigned a value of 100.

TABLE 1

| Example | $NH_4SCN$ Concentration | 0.2 Intercept Speed | Relative Speed | % Ag in Silver Halide Solvent Solution |
|---|---|---|---|---|
| 2-A Control | 5% | 1.77 | 100 | 0% |
| 2-1 (AgSCN) | 5% | 1.82 | 112 | 0.82% |
| 2-B Control | 6% | 1.67 | 100 | 0% |
| 2-2 (AgBr) | 6% | 1.73 | 115 | 0.85% |
| 2-C Control | 7% | 1.51 | 100 | 0% |
| 2-3 (AgCl) | 7% | 1.63 | 132 | 0.86% |

From the foregoing it will be seen that an increase in photographic speed is obtained by employing a silver salt in the silver halide solvent solution and that this effect is achieved with a variety of silver salts.

EXAMPLE 3

A fine-grain photosensitive silver iodobromide emulsion (4 mole % I, gelatin/Ag ratio of 0.075, grain diameter about 0.1 μm) was coated with a wire-wound coating rod onto a polyester base carrying a layer of cellulose acetate butyrate embossed with depressions about 1.8 μm in diameter, depth about 1 μm with center-to-center spacing of about 2.2 μm to provide a silver coverage of about 80 mg/ft$^2$. The emulsion contained surfactants as described in Example 1 to facilitate coating. The emulsion-coated embossed base was then dried.

The emulsion-coated embossed base was overlaid with a layer of 25 mg/ft$^2$ of gelatin carried on a subcoated 4 mil cellulose triacetate support and passed through rubber rollers with pressure applied thereto while a silver halide solvent solution was applied to the nip formed by the emulsion-coated embossed base and the gelatin-coated cover sheet. The silver halide solvent solution comprised 6% ammonium thiocyanate, 0.5% silver (as silver bromide, dissolved) and 1% gelatin.

The thus-formed lamination was heated for 1 min. at 85° C. and then cooled for about 2 min. at about −20° C. and the gelatin-coated cover sheet was detached from the embossed base.

Figure 2:
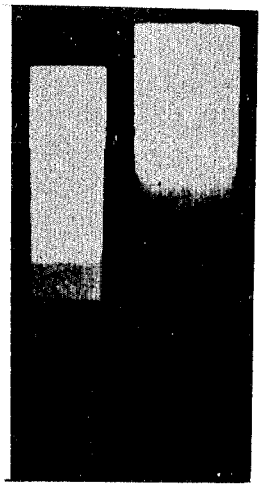
FIG. 2 is a positive image of a step tablet and continuous wedge obtained from an exposed and processed element prepared by the method of the present invention.

The thus-formed spaced array of grains was then exposed to a step tablet and continuous wedge at 2 mcs and diffusion transfer processed with a Type 42 processing composition and Type 107C receiving sheet (Polaroid Corporation, Cambridge, Mass.). The positive image of the step tablet and continuous wedge is shown in FIG. 2.

The photographic element of the present invention may be chemically sensitized by conventional sensitizing agents known to the art and which may be applied at substantially any stage of the process, e.g., during or subsequent to coalescence and prior to spectral sensitization.

Preferably, spectral sensitization of the photosensitive elements of the present invention may be achieved by applying a solution of a spectral sensitizing dye to the thus-formed single effective silver halide grains. This is accomplished by applying a solution of a desired spectral sensitizing dye to the finished element. However, the sensitizing dye may be added at any point during the process, including with the fine-grain emulsion or silver halide solvent solution. In a preferred embodiment, the spectral sensitizing dye solution contains a polymeric binder material, preferably gelatin.

Additional optional additives, such as coating aids, hardeners, viscosity-increasing agents, stabilizers, preservatives, and the like, also may be incorporated in the emulsion formulation.

What is claimed is:

1. In a method for forming a photosensitive element comprising a plurality of single effective silver halide grains which method comprises coalescing a fine-grain silver halide emulsion in a plurality of predetermined spaced depressions in a surface, the improvement which comprises carrying out said coalescence with a solution of silver halide solvent containing a dissolved silver salt.

2. The method of claim 1 wherein said surface is substantially planar.

3. The method of claim 1 wherein said silver salt is present in at least a 0.2% concentration as silver.

4. The method of claim 3 wherein said silver salt is present in at least a 0.5% concentration as silver.

5. The method of claim 4 wherein said solution of silver halide solvent is saturated with said silver salt.

6. The method of claim 1 which includes the step of depositing said fine-grain emulsion in said spaced depressions.

7. The method of claim 1 wherein said fine-grain emulsion comprises grains about 0.01 to 0.50 um in average diameter.

8. The method of claim 7 wherein said fine-grain emulsion comprises grains about 0.1 um or less in diameter.

9. The method of claim 1 wherein said fine-grain emulsion has a binder-to-silver ratio of 0.1 or less.

10. The method of claim 8 wherein said binder to silver ratio is about 0.075.

11. The method of claim 1 wherein said silver halide solvent is ammonium thiocyanate.

12. The method of claim 1 wherein said silver salt is silver thiocyanate.

13. The method of claim 1 wherein said silver salt is silver bromide.

14. The method of claim 1 wherein said solution of silver halide solvent includes a polymeric binder material.

15. The method of claim 13 wherein said polymeric binder material is gelatin.

16. The method of claim 1 wherein said coalescence includes the application of heat subsequent to the application of said solution of silver halide solvent.

17. The method of claim 16 which includes the step of cooling subsequent to said application of heat.

18. The method of claim 1 wherein a cover sheet is overlaid said depressions during coalescence.

19. The method of claim 18 wherein said cover sheet is removed subsequent to said coalescence.

20. A method for forming a photosensitive element comprising a plurality of single effective silver halide grains in a predetermined spaced array which comprises the following steps in sequence:

(a) depositing a fine-grain silver halide emulsion in a surface containing a plurality of predetermined spaced depressions;

(b) applying a solution of silver halide solvent saturated with a silver salt in an amount sufficient to partially dissolve said grains in said depressions; said (c) coalescing said grains to a single effective silver halide grain in substantially each depression.

21. The method of claim 20 which includes the step of applying a cover sheet over said depressions substantially contemporaneously with the application of said solution of silver solvent.

22. The method of claim 20 wherein said solution of silver halide solvent is disposed in a nip formed by a cover sheet and said surface and applying pressure to said cover sheet and said surface.

23. The method of claim 22 wherein said pressure is applied by passing said cover sheet and said surface between pressure applying rollers.

24. The method of claim 20 wherein said coalescence includes the application of heat subsequent to said partial dissolution of said emulsion.

25. The method of claim 24 which includes the step of cooling subsequent to said application of heat.

26. The method of claim 22 wherein said cover sheet is removed subsequent to said coalescence.

27. The method of claim 20 wherein said fine-grain emulsion comprises grains about 0.01 to 0.50 μm in average diameter.

28. The method of claim 27 wherein said fine-grain emulsion comprises grains about 0.1 μm or less in diameter.

29. The method of claim 20 wherein said fine-grain emulsion has a binder-to-silver ratio of about 0.1 or less.

30. The method of claim 29 wherein said binder to silver ratio is about 0.075.

31. The method of claim 20 wherein said silver halide solvent is ammonium thiocyanate.

32. The method of claim 20 wherein said silver salt is silver thiocyanate.

33. The method of claim 20 wherein said silver salt is silver bromide.

34. The method of claim 20 wherein said solution of silver solvent includes a polymeric binder material.

35. The method of claim 34 wherein said polymeric binder material is gelatin.

* * * * *